US005092614A

United States Patent [19]

Malewicz

[11] Patent Number: 5,092,614

[45] Date of Patent: Mar. 3, 1992

[54] LIGHTWEIGHT IN-LINE ROLLER SKATE, FRAME, AND FRAME MOUNTING SYSTEM

[75] Inventor: Andrzej M. Malewicz, Minnetonka, Minn.

[73] Assignee: Rollerblade, Inc., Minnetonka, Minn.

[21] Appl. No.: 550,560

[22] Filed: Jul. 10, 1990

[51] Int. Cl.[5] ..... A63C 17/06

[52] U.S. Cl. ..... 280/11.22; 280/11.27; 280/11.3

[58] Field of Search ..... 280/11.12, 11.19, 11.2, 280/11.22, 11.23, 11.27, 11.3, 7.13, 841

[56] References Cited

U.S. PATENT DOCUMENTS

| | | | |
|---|---|---|---|
| D. 264,612 | 5/1982 | Szegi | D21/226 |
| 310,923 | 1/1885 | Wardwell | 280/11.27 X |
| 377,704 | 2/1888 | Whelpley | 280/11.12 |
| 2,461,057 | 2/1949 | Hirschman | 280/11.27 |
| 3,993,318 | 11/1976 | Rothmayer | 280/11.26 |
| 3,999,772 | 12/1976 | Brennan | 280/11.23 |
| 4,008,901 | 2/1977 | Conn | 280/7.13 |
| 4,351,537 | 9/1982 | Seidel | 280/11.12 |
| 4,711,458 | 12/1987 | Shim | 280/11.22 |
| 4,909,523 | 3/1990 | Olson | 280/11.2 |

FOREIGN PATENT DOCUMENTS

| | | | |
|---|---|---|---|
| 0295081 | 12/1988 | European Pat. Off. | 280/11.22 |
| 0295824 | 12/1988 | European Pat. Off. | 280/11.22 |
| 2304853 | 8/1974 | Fed. Rep. of Germany | 280/11.19 |
| 2566672 | 1/1986 | France | 280/11.22 |
| 89/11894 | 6/1989 | PCT Int'l Appl. . | |
| 6160 | of 1894 | United Kingdom | 280/11.22 |

*Primary Examiner*—Robert P. Olszewski
*Assistant Examiner*—Brian L. Johnson
*Attorney, Agent, or Firm*—Moore & Hansen

[57] ABSTRACT

An in-line roller skate having a frame including a pair of side rails, each side rail having front and rear mounting brackets for attachment of the frame to the boot of the in-line roller skate. Each frame side rail includes a curved portion and a planar portion. The planar portion carries a plurality of axle apertures through which an axle for a wheel may be inserted. Perferably the axle apertures are configured to receive an axle aperture plug, have an eccentrically disposed axle bore and are situated on the frame side rails such that the wheels may be mounted at multiple relative heights to each other.

33 Claims, 3 Drawing Sheets

LIGHTWEIGHT IN-LINE ROLLER SKATE, FRAME, AND FRAME MOUNTING SYSTEM

The present invention relates to in-line roller skates in general and to the frames and frame mounting systems for such skates in particular.

BACKGROUND OF THE PRESENT INVENTION

The in-liner roller skating market is a rapidly expanding one, with attention being focused on providing a lighter, faster, more responsive skate that is easily and effectively manufactured. Presently available skates typically utilize a somewhat heavy frame riveted to the sole of a boot and having a pair of longitudinally extending side rails rotatably supporting a plurality of wheels disposed therebetween. The more modern of these frames have been manufactured from a synthetic material and have utilized fairly thick walled, substantially planar sidewalls.

While the skate frame needs to safely withstand certain stresses and strains introduced during skating, the frame should be as light as possible so as to result in less fatigue to the skater. The frame should be aesthetically pleasing, easy to assemble to a skate boot and safe and durable. The frame should be capable of attachment to the boot in a quick easy manner to simplify assembly and reduce manufacturing costs. Such a frame should also include a plurality of axle apertures that are selectively disposed on the frame such that the in-line roller skater may selectively choose from a variety of relative heights at which the wheels are mounted.

OBJECTS OF THE PRESENT INVENTION

It is a principal object of the present invention to provide an extremely light-weight but suitably strong frame for rotatably supporting a plurality of wheels.

It is another object of the present invention to provide an in-line roller skate having an improved frame and an improved mounting system for mounting the frame to the boot of an in-line roller skate using only a single tool.

It is yet another object of the present invention to provide an improved in-line roller skate having an improved frame mounting system that is simpler than prior art fastening systems and that reduces the manufacturing costs associated with assembling the frame to the boot.

SUMMARY OF THE PRESENT INVENTION

A light weight in-line roller skate having a new and improved frame and frame mounting system needing only a single tool to mount the frame to the skate boot is provided by the present invention.

A skate in accordance with the present invention includes a boot having a sole defined in part by inner and outer sole surfaces. The outer sole surface of the boot has front and rear frame mounts disposed thereon. The frame mounts are similarly configured, each mount having a ceiling and front and rear stop barriers extending downwardly from the outer sole. The ceiling has a substantially rectangular and planar configuration situated such that when the skate is in a generally upright position the ceiling will be disposed substantially parallel to a skating surface. The front and rear stop barriers are orientated substantially perpendicularly to the ceiling, and together with the ceiling, define a slot therebetween. The ceiling includes a centrally located, circularly configured aperture for receiving a fastener.

The frame of a skate in accordance with the present invention includes first and second longitudinally extending side rails. The first side rail includes front and rear mounting brackets extending laterally from the first side rail toward the second side rail. Each mounting bracket of the first side rail has a substantially planar floor and front and rear walls extending downwardly therefrom, forming therebetween a three sided bracket slot. The top floor includes top and bottom floor surfaces and has a substantially circular fastener aperture extending therebetween to receive the fastener. The front and rear mounting brackets of the first side rail are configured for a slidably snug but removable reception by the front and rear frame mounts. The top surface of each bracket floor will lie substantially flush with and bear against a frame mount ceiling when the frame and the boot are attached to each other.

The second side rail also has front and rear mounting brackets, each extending laterally from the second side rail to the first side rail and each configured to be received by a bracket slot of the front and rear brackets respectively of the first side rail. Each second rail mounting bracket includes a fastener aperture configured to receive the fastener. Each second side rail mounting bracket may also include a box channel having a substantially rectangular cross section and defining a socket for receiving and retaining a threaded fastener and to prevent rotation thereof. In a preferred embodiment, each box channel is defined by a substantially planar top wall; a pair of substantially planar, opposing, spaced apart, parallel side walls that extend downwardly from the top wall; and a pair of longitudinally extending, mutually opposed lips extending forwardly and rearwardly from the bottom of the side walls. In the preferred embodiment just described, the top wall of each second rail mounting bracket includes the previously mentioned fastener aperture. Each box channel may further include positioning means for accurately disposing an inserted threaded fastener directly below the fastener aperture.

The boot of a skate in accordance with the present invention further includes an inner sole having a front and a rear pair of concentric disk shaped depressions each pair concentrically disposed about a fastener aperture. Each depression pair includes a smaller diameter, lower disposed depression and a relatively larger diameter, upper disposed depression. Each depression is configured so as to be capable of receiving therein a washer. The depressions are disposed within the inner sole and the threaded fastener is so selected that the threaded fastener head will lie flush with or below the inner sole surface.

With a fastener system of the present invention, a frame is attached to a skate boot by inserting a threaded fastener such as a flat or low profile round head bolt having a threaded end through the fastener aperture of the sole, through the fastener aperture of a first rail bracket floor, through the fastener aperture of a second rail mounting bracket, and by attaching a threaded nut or similar fastener thereto. In a preferred embodiment the threaded end would be inserted into the box channel of a second rail mounting bracket where it would be threaded into a nut previously placed in the box channel.

Prior to screwing the fastener into the retained nut, a small tensioning gap is present between each frame mount ceiling and its respective floor of a first rail mounting bracket. As the fastener is screwed into the nut the sole of the boot is pulled downwardly until the ceiling and the top surface of the bracket floor lie flush with and bear against each other. The sole of the boot is thus placed under tension as the gap is closed, thereby providing a more rigid sole and, consequently, providing a desirable resistance to additional flexure in the sole area of the boot without the addition of thicker sole material or added weight.

The frame mounting system of the present invention may also include a plurality of fingers extending perpendicularly upward from the top edge of each of the first and second side rails and a corresponding plurality of mating apertures disposed in the outer sole of the boot, each mating aperture being configured to receive a finger therein. Preferably these fingers are disposed so as to minimize twisting of the frame and lateral movement of the upper edges of the side rails in relation to the sole of the boot. As the frame is tightened onto the boot, the upper edges of the frame lie flush with and bear against the boot sole and the fingers cam in their respective mating apertures, thereby contributing to the tensioning of the sole, rigidly positioning the upper edges of the frame with respect to the boot sole, and providing a total interlinked frame structure that resists flexing from skater and skating generated forces.

A frame in accordance with the present invention further includes a plurality of pairs of axle apertures disposed at selected heights on the longitudinally extending side rails. The axle apertures each have a substantially oval configuration defined by a longitudinal axis and are orientated generally upright on the frame side rails such that the longitudinal axis is substantially perpendicular to a planar skating surface. In a frame carrying four wheels, the axle apertures for the center two wheels are disposed at a level slightly lower than the apertures for the front and rear wheel. Preferably, the front and rear apertures are placed at a height above the center apertures so as to achieve three separate wheel height relations: a first relation where all four wheels have a rotational axis lying in a single plane; a second relation where the axes of rotation of the two center wheels lie in a first common rotational plane and the axes of rotation of the front and rear wheels lie in a second common rotational plane disposed above the first plane; and a third relation where the axes of rotation of the center wheels lie in a first common rotational plane and the axes of rotation of the front and rear wheels lie in a third common rotational plane disposed above the second common rotational plane. This placement of the apertures allows the more accomplished skater, who often skates on only two wheels, which may at various times comprise the two center, the two front, or the two rear wheels, or changing pairs thereof, to set the front and rear wheels at different heights with respect to the center wheels as desired.

Each side rail of a frame in accordance with the present invention may have an inner and an outer surface that each include a curved portion and a planar portion that carries the axle apertures. The curved portion of each side rail has a generally convex outer surface configuration extending rearward from the front of the rail substantially to the rear end thereof and from the top of the frame downward to approximately the top of the axle apertures. A concave surface forms part of the inner surface of the side rail and includes a plurality of reinforcing ribs extending between the top of the planar portion to the top of the frame, which enable the frame to withstand the stresses introduced therein by the skater and by defects in the skating surface. The use of the curved configuration for the side rails allows the weight of the frame to be reduced to approximately half of that of presently available frames, thereby enabling skaters to skate faster and longer and jump higher while becoming less fatigued doing so.

The foregoing objects of the invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
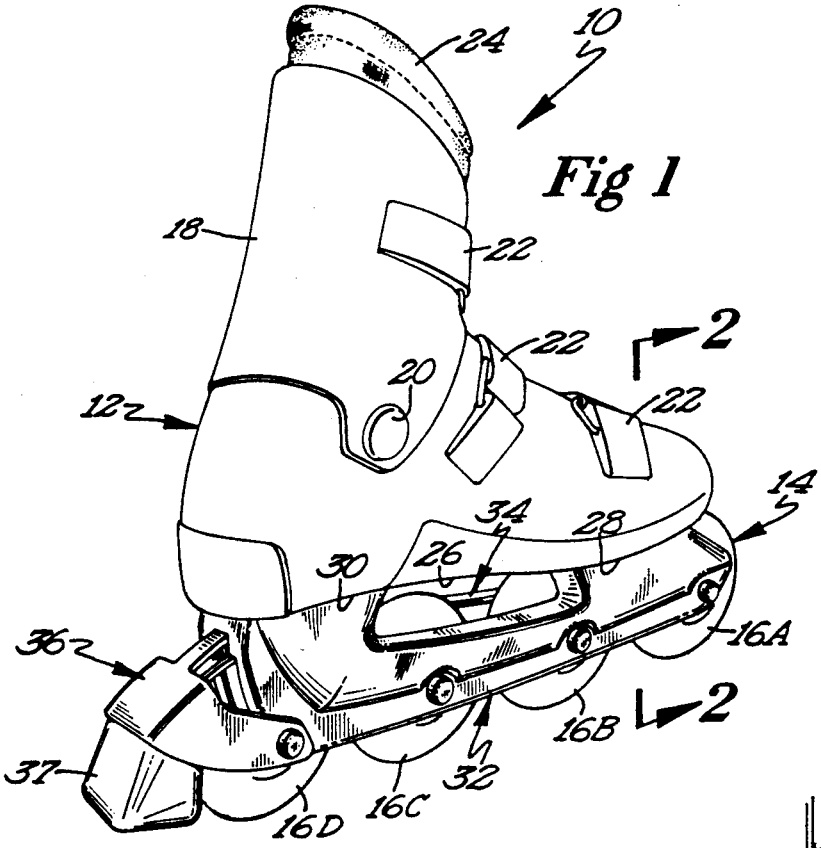
FIG. 1 is a perspective view of an in-line roller skate illustrating an improved frame in accordance with the present invention.

FIG. 1 illustrates in perspective an in-line roller skate 10 in which the present invention may be utilized. Skate 10 includes a boot 12 and a frame 14 attached thereto. Frame 14 rotatably supports a plurality of wheels 16A, 16B, 16C, and 16D. Frame 14 is attached to a sole 26 of boot 12 at a front sole attachment 28 and a rear sole attachment 30. Frame 14 includes a first and a second side rail, 32 and 34 respectively. Frame 14 may include a brake assembly 36 having a braking means 37 with which a skater may use to stop.

Boot 12 includes a cuff 18 pivotally attached to boot 12 at a cuff pivot 20. Boot 12 further includes a plurality of closure 5 means 22 for closely conforming boot 12 to a skater's foot. As shown in the Figure, closure means 22 include individual buckle type closures; other known means of tightening a boot onto a foot, such as laces and eyelets, are also within the scope of the present invention, however. Boot 12 may include a liner 24 which may be removable if desired.

Figure 2:
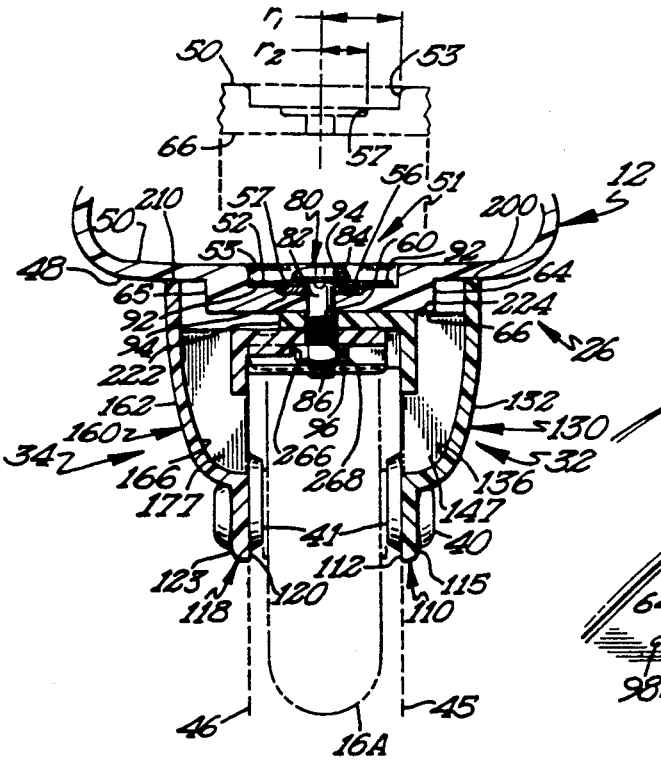
FIG. 2 is a cross-sectional view of the frame mounting system of the present invention taken along cutting plane 2—2 of FIG. 1.
Figure 3:
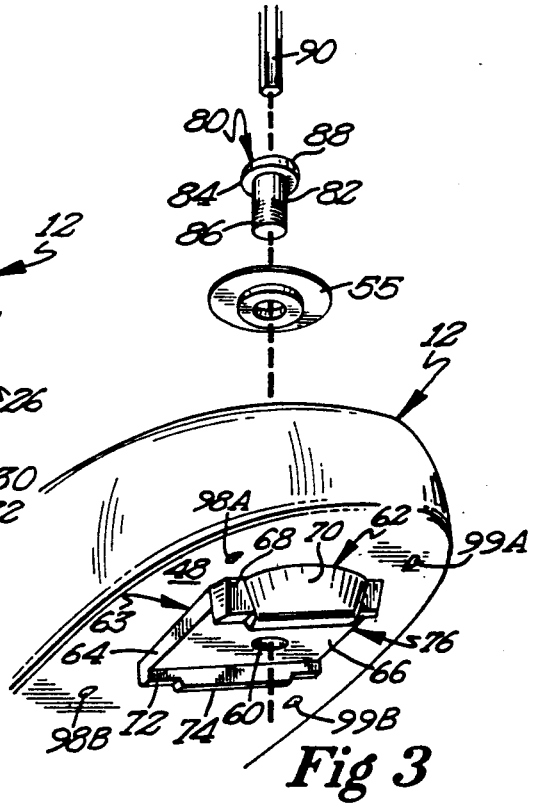
FIG. 3 is a perspective view depicting a front frame mount of an in-line roller skate.

Referring now to FIG. 3, sole 26 of boot 12 includes an outer sole 48 and an inner sole 50 (shown in FIG. 2). Outer sole 48 includes a front frame mount 62 and a substantially similarly configured rear frame mount (not shown). Because both front and rear frame mounts are similarly configured, only front mount 62 will be described, the description thereof being equally applicable to the rear frame mount. Thus each frame mount, such as mount 62, includes a ceiling 66, which may be the outer sole surface 48 of sole 26 and fore and aft stop barriers 68 and 72 respectively extending downwardly from outer sole 48. A laterally extending, three sided slot, 76 is defined between forward and aft stop barriers 68 and 72 respectively. The stop barriers preferably extend downwardly perpendicularly to ceiling 66 and transversely to a forward skating direction, that is, transversely to longitudinally extending rails 32 and 34. Mount 62 further includes a fastener aperture 60 that extends between inner sole surface 50 and ceiling 66, and that a substantially centrally disposed on ceiling 66. As shown in the figure, forward stop barrier 68 maybe supported by a forward gusset 70 while aft stop barrier 72 may be supported by an aft gusset 74.

In a preferred embodiment frame mount 62 has a pedestal-like configuration. Thus mount 62 includes a base 63 defined by a pair of lateral side walls 64 and 65 and forward and aft stop barriers 68 and 72. Ceiling 66 and slot 76 are thus raised off of outer sole surface 48 in this embodiment, thereby providing a sufficient amount of sole material into which the fastener receivers 51, to be discussed below, may be placed. Slot 76 retains its laterally extending substantially parallelogram configuration.

Referring specifically to FIG. 2 now, inner sole surface 50 of boot 12 includes front and rear fastener receivers 51. Each receiver 51 is defined by first and second washer receptacles 52 and 56, which each may have a substantially disk-like configuration defined in part by a substantially circular side wall 53 and 57 respectively. The washer receptacles may have different radii. Thus, as shown in the Figure, receptacle 52 has a radius $r_1$ that is greater than the radius $r_2$ of receptacle 56, which is disposed deeper within sole 26 than is receptacle 52. Washer receptacles 52 and 56 are concentrically disposed about fastener hole 60, which extends between outer sole surface 48 and inner sole surface 50, and receive washers 92 and 94 respectively (shown in FIG. 2).

Fastener hole 60 is configured to receive a fastener 80 which may be a flat or low profile round head bolt. Fastener 80 includes a fastener shaft 82 and a fastener head 84 disposed at one end of shaft 82 and a threaded end 86 disposed at the other end of shaft 82. Fastener head 84 may have a fitting 88 disposed therein capable of receiving a fastener tool 90. As shown in the Figures, fitting 88 is an allen-type fitting and fastener tool 90 is an allen-type wrench. A first washer 92 and a second washer 94 are received by first and second washer receptacles 52 and 56, respectively. As shown in FIG. 3, these washers may be integral with one another to form a unitary washer means 55, or as shown in FIG. 2, they may be separate articles. A threaded fastener such as nut 96 may be turned onto threaded end 86 when frame 14 is attached to boot 12. Preferably threaded fastener 96 or threaded fastener 97, seen in FIG. 4, should include a lock feature such as a nylon washer carried by the threaded surface of the fastener. The configuration of washer 92 and 94 and fastener head 84 should be selected so that the top of fastener head 84 does not extend above inner sole surface 50 when frame 14 is attached to boot 12. Should it do so, harmful rubbing may occur between the fastener head 84 and the bottom of a skater's foot.

Referring now to FIGS. 2, 4, 5 and 6, rails 32 and 34 of frame 14 will be further described as will the apparatus by which they are attached to boot 12. A frame such as that to be described could be manufactured of a thirty percent glass filled nylon material. As noted previously in the discussion of FIG. 2, frame 14 includes a first side rail 32 and a second side rail 34. As shown in the Figures, first rail 32 is shown as being the inside rail on a left boot and second rail 34 is shown a being the outside rail on a left boot. The attachment system of the present invention is symmetric, however, and, thus in accordance with the present invention, rails 32 and 34 could also be used on a right boot and the mounting brackets to be discussed below could be placed on either rail.

Figure 4:
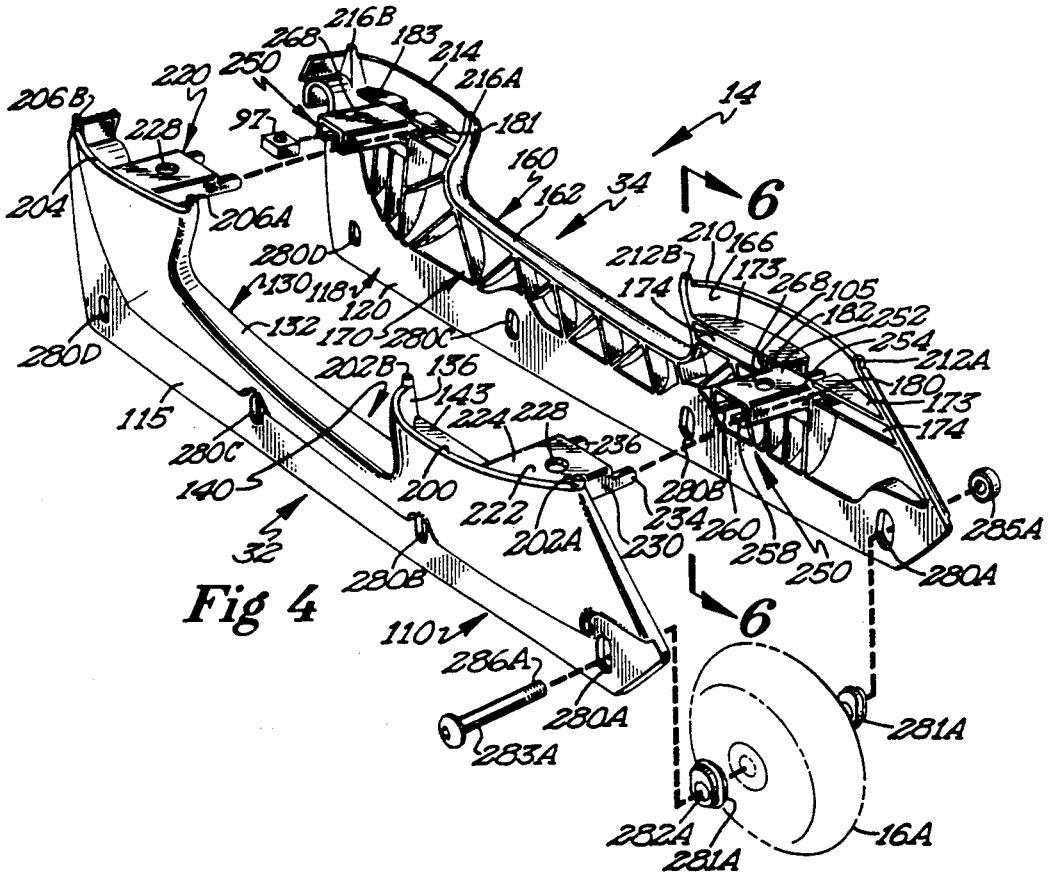
FIG. 4 illustrates in an exploded perspective view the inline roller skate frame shown in FIG. 1.
Figure 5:
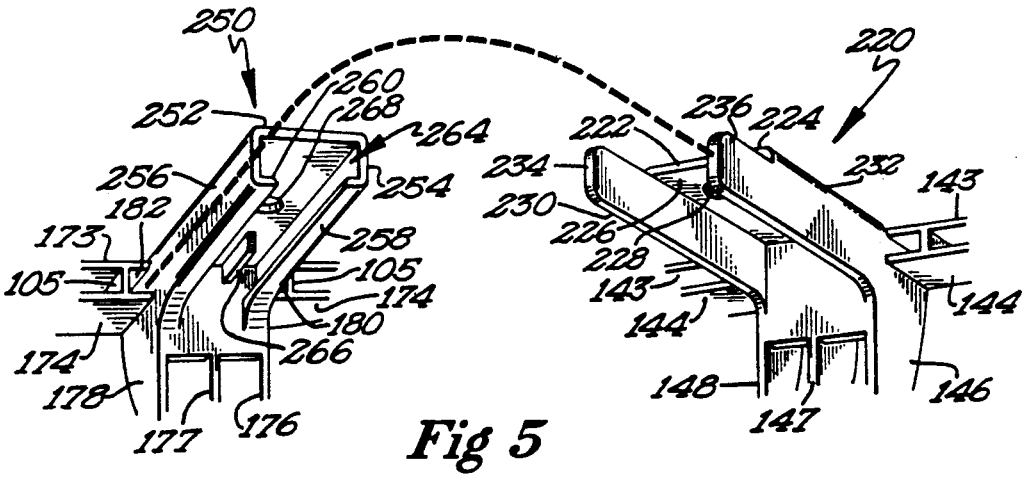
FIG. 5 is a perspective view from the underside thereof of a mounting bracket and its respective guide and stop apparatus and a perspective view of the underside thereof of a mounting bracket having a box channel.

As best seen in FIGS. 4 and 5, first rail 34 includes front and rear mounting brackets 220. Each bracket is substantially similar to the other and consequently, the discussion shall be referenced with respect to only the front mounting bracket 220. Thus front mounting bracket 220 extends laterally from an inner concave surface 136 of first rail 32 toward second rail 34, as best seen in FIGS. 2 and 4. Bracket 220 includes a bracket floor 222 having a top surface 224 and a bottom surface 226 and a fastener aperture 228 extending between top and bottom surfaces 224 and 226 respectively. Bracket 220 further includes front and rear side walls 230 and 232 respectively, extending downwardly from bracket floor 222. Extending laterally from the lower portion of front and rear walls 230 and 232 are front and rear bracket guides and stops 234 and 236 respectively, whose functions will be detailed later. A bracket channel 238 is defined between front and rear walls 230 and 232 and bottom surface 226 of bracket 220. Frame mounting bracket 220 is configured to be slidably and snugly received within laterally extending slot 76 of frame mount 62. Thus, when frame 14 is attached to boot 12, top surface 224 of floor 222 will lie substantially flush with and bear against ceiling 66 of frame mount 62, as shown in FIG. 2. Additionally, front wall 230 will confront forward stop barrier 68 and rear wall 232 will confront stop barrier 72. Forward and aft stop barriers 68 and 72, then, define the limits of forward and rearward movement of frame 14 when shear forces are applied to the skate 10 by a skater.

Referring now to FIGS. 4 and 5, the mounting brackets of second rail 34 will be described. Thus, second rail 34 includes front and rear mounting brackets 250. Like the brackets of the first side rail, front and rear brackets 250 are substantially identical and thus a description of one will be applicable to the other. Each mounting bracket 250 laterally extends from an inner concave surface 166 of second rail 34 towards first rail 32. Bracket 250 includes a top wall 252 and front and rear side walls 254 and 256 depending downwardly therefrom. A forward lip 258 extends rearwardly from the bottom of front wall 254 toward rear wall 256. Similarly, a rear lip 260 extends forwardly from the bottom of rear wall 256 towards front wall 254. As shown, lips 258 and 260 do not touch, though they may do so, thereby forming a solid wall, and such a variation is within the scope of the present invention. An open-ended fastener socket 264 is defined by top, front and rear side walls 252, 254, and 256, respectively, and forward and rear lips 258, 260. A threaded fastener such as hex nut 96 shown in FIG. 2 or square nut 97 shown in FIG. 4 can be inserted into socket 264 through an open end 265 thereof. Threaded fastener 96 should be chosen such that it is received by socket 264 and prevented from rotating therein. That is, threaded fastener 96 should have a width between opposed tooling surfaces no greater than the width between front and rear walls 254 and 256. A fastener stop 266, which may be an extension of a middle vertical rib 177, to be discussed further below, functions to position a threaded fastener such as nut 96 or nut 97 directly beneath a fastener aperture 268 extending through top wall 252. Fastener stop 266 will position threaded fastener 96 such that the threaded opening in the threaded fastener will lie directly below and concentrically with fastener aperture 268 Preferably, mounting brackets 250 should be configured to be snugly, but slidably received within bracket channel 238 of first rail mounting brackets 220. When so placed, top wall 252 will bear against bottom surface 226 of bracket 220, front wall 254 of second side rail mounting bracket 250 will confront front wall 230 of first side rail mounting bracket 220, and rear wall 256 of second side rail mounting bracket 250 will confront rear wall 232 of first side rail mounting bracket 220. When so positioned front and rear side walls 230 and 232 will define the forward/rearward extent of movement allowed bracket 250 and, consequently, to side rail 34 with respect to side rail 32 and boot sole 26.

Second rail 34 further includes front and rear guide sockets 180 and 1 82 respectively disposed fore and aft of front mounting bracket 250. Similarly, the rear mounting bracket 250 is flanked by front and rear guide sockets 181 and 183 respectively. Each guide socket is similarly configured and thus a description of one will suffice for all four. Rear guide socket 182, disposed rearwardly of front mounting bracket 250 of second rail 34, is defined by: a top and a bottom horizontally extending rib 173 and 174 respectively; rear side wall 256 of mounting bracket 250; a riblet 105 extending vertically between top and bottom horizontal support ribs 173 and 174 respectively; and by concave inner surface 166. Thus each guide socket is defined by the concave inner surface, the horizontal ribs, a mounting bracket side wall, and a vertical riblet extending between the horizontal ribs. Each guide socket is configured to slidably receive a guide, such as rear guide 236 of mounting bracket 220. Each guide and its respective guide socket functions to properly position and support the first and second rails 32 and 34 with respect to each other in the lateral direction as well as in the longitudinal direction. Furthermore, they provide a removable attachment mechanism for the rails. That is, when first and second rails 32 and 34 are joined for attachment to boot 12, guides 234 and 236 of front mounting bracket 220 will be slidably received by front and rear guide sockets 180 and 182 of front mounting bracket 250 respectively. The insertion of the guides into the guide sockets act as an interlock to prevent the guide rails from pivoting away from each other. That is, because of the insertion of the guide sockets, rails 32 and 34 are removably connected to one another to form frame 14. By grasping second rail 34, frame 14 can be lifted and handled as a unit rather than as individual rails, thereby simplifying handling and making assembly of the frame to the boot easier than in prior two piece skate frames.

As previously noted, first rail 32 further includes a front mounting surface 200 and a rear mounting surface 204. Each mounting surface includes a pair of upwardly extending fingers 202A-B and 206A-B respectively. Similarly, second rail 34 includes a front mounting surface 210 having a pair of upwardly extending fingers 212A-B and a rear mounting surface 214 having a pair of upwardly extending fingers 216A-B. Each finger has a substantially half-oval configuration at the base thereof that narrows somewhat from there upwards. Fingers 202A-B, 206A-B, 212A-B and 216A-B are received within their individual respective mating apertures disposed in outer sole 48 of boot 12. The mating apertures, best seen in FIG. 3 are configured to receive a single finger. As shown in FIGS. 3 and 4, fingers 202A and 202B would be slidably received by mating apertures 98A and 98B while fingers 212A and 212B would be slidably received by mating apertures 99A and 99B when frame 14 is attached to boot 12. Similarly, but not shown, mating apertures would be disposed on the rear portion of sole 26 and would slidably receive fingers 206A and 206B and 216A and 216B respectively. While the fingers and apertures have been described as having a half-oval type of configuration, other configurations also fall within the scope of the present invention.

The following procedure describes the basic method of attaching frame 14 to boot 12. Thus, a threaded fastener 96 would first be inserted into fastener socket 264 of each front and rear mounting brackets 250. First and second rails 32 and 34 would then be joined to one another by slidably inserting front and rear mounting brackets 250 into front and rear bracket slots 238 of front and rear mounting brackets 220 respectively such that each guide, such as guide 234, is respectively disposed within its guide socket, such as guide socket 180. The two joined rails would then be placed against outer sole 48 of boot 12 such that top surface 224 of each front and rear mounting bracket 220 is respectively received by front and rear slots 76 of front and rear frame mounts 62. When properly positioned, fingers, such as fingers 202A-B and 206A-B, will be mateably received within their respective mating apertures, such as mating apertures 98A-B and 99A-B respectively. Washers 92 and 94 may be then respectively inserted within first and second washer receptacles 52 and 56, or as previously noted, a single integral washer 55 may be inserted therein. Fastener 80 may be inserted through washers 52 and 56 (or through integral washer 55), through fastener hole 60, fastener aperture 228 of mounting bracket 220, and fastener hole 268 of mounting bracket 250. A fastening tool such as allen tool 90 may then be used to turn threaded end 86 of fastener 80 into threaded fastener 96. As noted previously, because fastener 96 is received within fastener socket 264 of mounting bracket 250 in a manner that prevents rotation thereof, fastener 80 may be turned into threaded fastener 96 using only a single tool, thereby simplifying assembly of frame 14 to boot 12.

Figure 6:
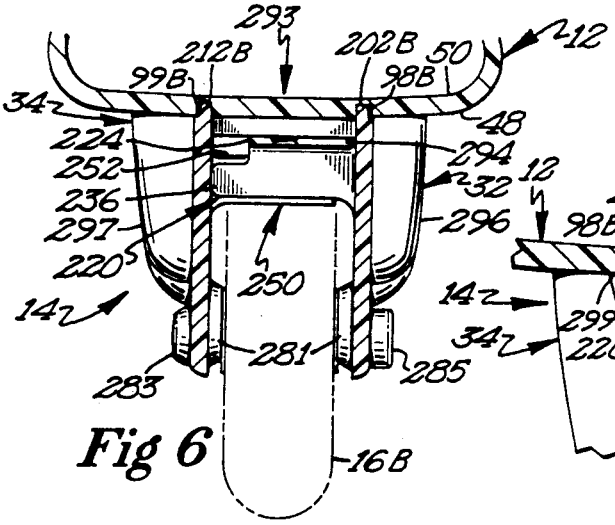
FIG. 6 is a cross sectional view along lines 6—6 of FIG. 4 showing the frame of the present invention positioned against the boot sole prior to fastening the frame to the boot.

As shown in FIG. 6, prior to turning fastener 80 into fastener 96 outer sole surface 48 will be disposed in a first position 293 relative to top surface 224. A small gap 294, shown in exaggerated size for purposes of clarity, will be present between top surface 224 of mounting bracket 220 and ceiling 66 of frame mount 62. As fastener 80 is turned into threaded fastener 96, sole 26 of boot 12 will be pulled downwards toward bracket 220 to a second, fastened sole position 295, seen in FIG. 7 wherein surface 224 lies substantially flush with and bears against ceiling 66, thereby placing sole 26 of boot 12 under tension. Placing sole 26 under tension strengthens it without the use of additionally material in the sole, i.e. without making the sole thicker. The boot can be made lighter resulting in a lighter in-line roller skate.

Figure 7:
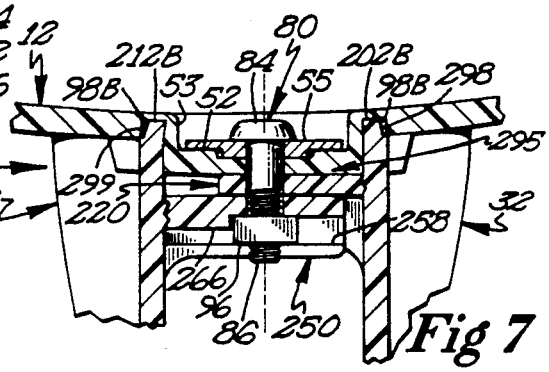
FIG. 7 is a cross sectional view like that of FIG. 6 but wherein the sole of the boot is tensioned against the frame and showing camming of the frame's fingers in their mating apertures.

Furthermore, each finger will mate with its respective mating aperture when frame 14 is placed against sole 26 of boot 12. Thus, as seen in the figure, fingers 202B and 212B are respectively disposed within mating apertures 98B and 99B. Each 98B and 99B is in a first position 296 and 297. As fastener 80 is turned into threaded fastener 96 and sole 26 is pulled downwards, a plurality of fingers will cam within their respective mating apertures. Thus, as seen in FIG. 7, mating apertures 98B and 99B will be tilted slightly to a second position 298 and 299 respectively by the tensioning of the sole. This tilting or cocking of the apertures, shown exaggerated for purposed of clarity, causes the individual fingers to cam within their apertures.

This camming action functions to lock the upper edge of frame 14 into position with respect to boot 12. In other words, in the embodiment shown in the drawings, frame 14 is positionally fixed with respect to boot sole 26 at ten separate locations. Thus, frame 14 is fixed in position with respect to sole 26 by the forward finger/-mating aperture locations 202A, 98A; 202B, 98B; 212A, 99A; 212B, 99B; by the rear engagement of fingers 206A-B, 216A-B with the rearwardly disposed mating apertures; and by the front and rear brackets and frame mounts. Of course, frame 14 could be positionally fixed at fewer or more locations depending upon the number of finger/mating aperture combinations that are selected to be used. It is within the scope of the present invention to have a continuous finger that extends along the upper edge of each side rail and that mates with a properly disposed groove in outer sole 38. With such configurations of fingers and mating apertures and bracket attachment apparatus, frame 14 is prevented from movement along the upper edge thereof in either forward/rear or side to side directions.

In a further description of side rails 32 and 34, and referring particularly to FIGS. 2 and 4, first rail 32 includes a planar portion 110 having inside and outside planar surfaces, 112 and 115 respectively. Second rail 34 includes a planar surface 118 having an inside planar surface 120 and an outside planar surface 123. Disposed on the planar surfaces are a plurality of axle apertures 280 extending between the inside and outside planar surfaces of each rail.

Referring now again to FIGS. 4 and 8A-the planar portion of each rail 32 and 34 respectively includes a plurality of axle apertures 280A-D that extend from the inside planar surface to the outside planar surface. As seen in the cross sectional view of FIG. 4, each axle aperture 280A-D carries an axle aperture plug 281A-D. Each plug 281A-D has a bore 282A-D for supporting a wheel axle 283A-D upon which a wheel 16, such as wheel 16A is rotatably mounted. A preferred embodiment of the axle aperture plugs and axle apertures are described in U.S. patent application Ser. No. 07/057,056, filed Jun. 12, 1987, and now U.S. Pat. No. 5,048,848, assigned to the same assignee as the present invention, that portion of that specification describing the wheel apertures and the axle aperture,, plugs being incorporated herein. As described in that patent application, each axle aperture plug has an eccentrically disposed axle bore. Thus, each plug is capable of mounting its respective wheel at one of two selected heights with respect to the bottom of rail 32 and 34.

Referring now to FIGS. 8A-8D, the possible relative wheel height arrangements will be discussed and explained. Thus as shown, in FIGS. 6 each wheel 16A-D is mounted for rotation by an axle 283A-D disposed in an axle bore 282A-D of an axle aperture plug 281A-D. Plug 281A-D is in turn disposed within an axle aperture 280A-D. As can be seen from the figures, bore 282A-D is eccentrically disposed on plug 281A-D such that reversing the position of plug 281A-D enables each wheel to be set at one of two selected heights relative to axle aperture 280A-D. Thus, by way of example rail 32 includes an axle aperture 280A disposed at a forward position on therein. Axle aperture 280A receives an axle aperture plug 281A having an axle bore 282A disposed therein. Bore 282A is configured to receive axle 283A for rotatably supporting wheel 16A. A threaded fastener 285A is attached to the threaded end 286A of axle 283A. Wheels 16B, 16C, and 16D, are all similarly mounted for rotation.

Figure 8A:
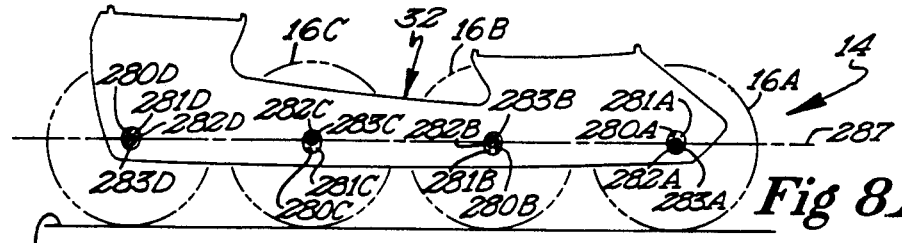
FIGS. 8A, 8B, 8C and 8D illustrate the respective relative wheel heights obtainable with a skate frame in accordance with the present invention.

FIG. 8A shows one system for positioning of axle apertures plugs 281A, 281B, 281C, and 281D such that all four wheels are at the same height level with respect to riding surface 284. As shown in the figure, forward and rear axle aperture plugs 281A and 281D are disposed within their respective axle apertures 280A and 280D such that axle bores 282A and 282D are in the lower portion of axle aperture 280A and 280D respectively. Meanwhile, axle aperture plugs 281B and 281C are disposed within axle apertures 280B and 280C such that their respective bores 282B and 282C are disposed in the upper portion of its respective axle aperture. By positioning the axle aperture plugs within their respective axle apertures as shown, the axis of rotation of all four wheels is at a uniform height lying in a common plane 287. A skater is therefore able to use all four wheels simultaneously when skating on a substantially planar surface.

Figure 8B:
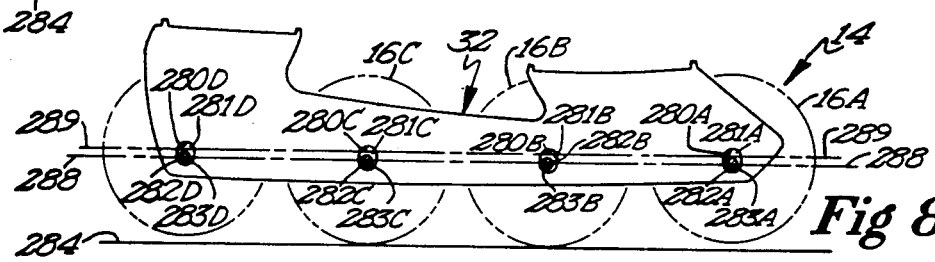

FIG. 8B shows a variation on positioning the axle aperture plugs such that the bore of each plug is disposed in the lower portion of its respective axle aperture. With such a configuration, center wheels 16B and 16C are disposed at a relatively lower level with respect to riding surface 284 than are outer wheels 16A and 16B. Center wheels 16B and 16C have a common plane of axis rotation as indicated by numeral 288 whereas front wheel 16A and rear wheel 16D rotate on their respective axis in a second common plane 289 disposed at a relatively higher level with respect to riding surface 284 than is plane 288.

Figure 8C:
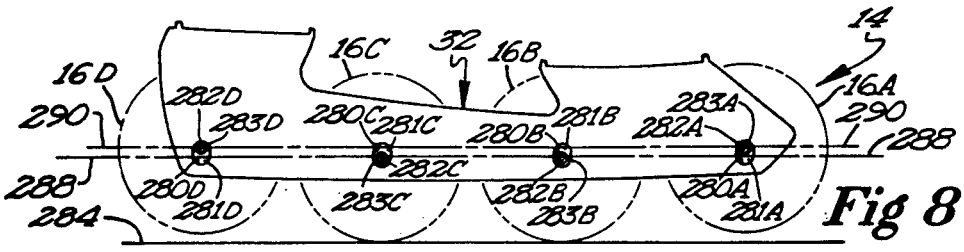
Figure 8D:
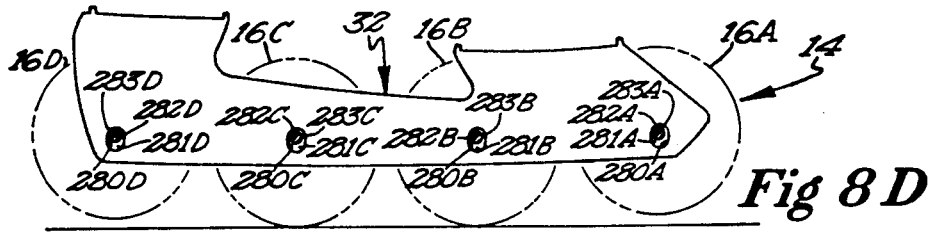

FIG. 8C shows yet a third configuration using a frame in accordance with the present invention. Thus, as shown in the figure, axle aperture plugs 281B and 281C are disposed within axle apertures 280B and 280C respectively such that bores 282B and 282C are positioned in the lower portion of the axle aperture. Axle aperture plugs 281A and 281D, however, are disposed within axle apertures 280A and 280D such that bores 282A and 282D respectively are positioned in the upper portion of the axle aperture. Thus, center wheels 16B and 16C again rotate on their respective axes lying in common plane 288 whereas outer wheels 16A and 16D now rotate on their respective axes, which now lie in plane 290. Plane 290 is disposed relative to riding surface 284 at a higher level than is plane 288 or 289. Thus, wheels 16A and 16D are lifted farther off the ground than they were previously as shown in FIG. 8B.

With either of the configurations shown in FIGS. 8B or 8C, a skater would skate on riding surface 284 with only two wheels, i.e., center wheels 16A and 16B, a practice many of the more experienced skaters prefer.

A fourth relative placement of the axle apertures is also possible, one wherein all of the axle aperture plugs are positioned within the axle apertures such that their respective axle bores are disposed in the upper portion of the axle aperture. This configuration, shown in FIG. 8D, however, results in a relative wheel height equivalent to that shown in FIG. 8B wherein all of the axle aperture plugs are disposed within their respective axle apertures such that the axle bores are positioned within the lower portion of the axle aperture.

In additional to the planar portions of rails 32 and 34 that carry the axle apertures, each rail 32, 34 includes a curved portion, 130 and 160 respectively. Each curved portion 130, 160 is defined by a convex outer side 132, 162 respectively and a concave inner side 136, 166 respectively. The concave portion 130, 160 of each side rail 32, 34 respectively extends substantially the longitudinal length of each rail and from the top of each rail downward to about the height of the top of axle apertures 280. The curved portion of each rail 32, 34 includes front and rear convex upper edges, 200, 204; 210, 214; respectively, which define mounting surfaces for engaging the boot sole and which lie substantially flush with and bear against outer sole 48 when frame 14 is mounted to boot 12. Each upper edge 200, 204; 210, 214 has a substantially crescent-like configuration. When rails 32 and 34 are attached to boot 12, the crescent like curvatures of the edges resist pivoting of frame 14 about outer sole 48 on an axis that lies along outer sole 48. Thus, front and rear mounting surfaces 200, 204; 210, 214 contribute to a safe, enjoyable operation for a skater by resisting side to side flexing of the frames. In turn, this resistance to flexing provides a more stable skate, but at a fraction of the weight of prior art skate frames. Additionally, the frames of the present invention, which include the curved portions 130 and 160, in general provide a more stable structure than prior art, completely planar frames because they resist lateral twisting and flexing more readily than such prior art frames and allow needed strength while allowing significant further weight reduction.

Extra structural support is provided to frame 14 over and above that provided by curved portions 130 and 160. Thus, concave inner sides 136 and 166 of first and second rails 32 and 34 respectively are supported by a plurality of diagonally extending truss ribs 140, and 170, disposed therein. Truss ribs 140 and 170 extend from their respective concave inner surface laterally towards the opposing rail 34, 32 respectively. The truss ribs do not extend beyond the inner planar surface of their respective rails, as indicated by dotted lines 45 and 46 in FIG. 2, however, so as not to interfere with the rotation of wheels 16.

First rail 32 and second rail 34 respectively also include a plurality of horizontal and vertically extending support ribs that support front and rear frame mounting brackets 220 and 250 respectively as well as provide the side rails with additional structural strength and integrity. Thus, each bracket is supported by top and bottom horizontally extending support ribs and by three vertically extending support ribs . As shown in the Figures, the vertically extending support ribs include top and bottom horizontal ribs 143 and 144 respectively and front, middle and rear support ribs 146, 147, and 148, respectively, supporting first rail frame mounting bracket 220. Similarly, second rail 34 includes top and bottom horizontally extending bracket support ribs 173 and 174 and a plurality of vertically extending support ribs, front vertical support rib 176, middle vertical support rib 177, and rear vertical support rib 178. Each of the bracket support ribs referred to provide additional structural strength to their respective brackets as well as reinforce their respective side rail against laterally and vertically deforming forces encountered during skating.

While the present invention has been thoroughly described, many modifications and alternatives thereto are possible. Thus while the present invention has been described as having three vertically supporting ribs and two horizontally disposed supporting ribs with respect to each mounting bracket, it is within the scope of the present invention to include more or less as required to provide the necessary structural support to frame 14 and the mounting brackets. Additionally, while mounting brackets 250, which include socket 264, have been described as having a gap between lips 58 and 60, each mounting bracket 250 could have a solid structure across the bottom thereof. While each rail 32 and have been described as having four upwardly projecting fingers disposed thereon for mating with appropriately positioned mating apertures on outer sole 48 of boot 12, it is within the purview of the present invention to include more or fewer as needed to provide the necessary structural support for each side rail. Having thus described the present invention, additional numerous changes, substitutions, modifications, and alterations may suggest themselves to those skilled in the art, all of which fall within the spirit and scope of the present invention. Accordingly, it is intended that the invention be limited only by the scope of the appended claims.

What is claimed is:

1. An in-line roller skate comprising:

a boot having a sole, said sole having an outer sole surface, said outer sole surface having front and rear frame mounts thereon, each said frame mount having forward and aft stop barriers and defining a laterally extending slot therebetween;

a plurality of wheels rotatable in a common plane;

a frame for carrying said plurality of wheels, said frame comprising first and second longitudinally extending side rails, wherein said first side rail includes front and rear mounting brackets, each said bracket projecting laterally from said first side rail toward said second side rail and having a bracket floor, each said bracket being received in one of said slots of said frame mounts when said frame is attached to said boot;

said second side rail includes front and rear mounting brackets, each said bracket projecting laterally from said second rail toward said first rail; and fastening means for attaching said rails to said boot by attaching said front bracket of said first rail to said front bracket of said second rail and said front frame mount, said front bracket of said first side rail being disposed between said front bracket of said second side rail and said front frame mount, and by attaching said rear bracket of said first side rail to said rear bracket of said second side rail and to said rear frame mount, said rear bracket of said first rail being disposed between said rear bracket of said second side rail and said rear frame mount.

2. The skate of claim 1 wherein:

each said floor is defined in part by a top floor surface and a bottom floor surface, and each rail includes an upper front edge and an upper rear edge, each of which confronts and lies substantially flush with said sole, each of said brackets of said first side rail being spaced downward from said outer sole surface to define a tensioning gap between said ceiling and said top floor surface when said front and rear edges initially contact said sole of said boot, each said gap closing as said sole is pulled towards said top floor surface as said frame is attached to said boot and said sole is placed under tension to provide a more rigid interface between said frame and said boot.

3. The skate of claim 2 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

4. The skate of claim 2 wherein:

said first and second side rails each have a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said finger cam in said mating apertures when said sole is being tensioned as said frame and said sole are attached to each other, said camming inhibiting lateral twisting and flexing of said side rails.

5. The skate of claim 4 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

6. The skate of claim 1 wherein:

said first and second side rails each have a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said fingers cam in said mating apertures when said sole is being tensioned as said frame and said sole are attached to each other, said camming inhibiting lateral twisting and flexing of said side rails.

7. The skate of claim 6 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

8. The skate of claim 1 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

9. The skate of claim 1 wherein each of said rails has a curved upper portion and a planar lower portion, said planar portions of each rail carrying a plurality of axle apertures, said curved portion including a convex outer surface and a concave inner surface carrying said brackets and including a plurality of reinforcing ribs, wherein said curved upper portion defines a curved rail bearing surface for bearing against said sole outer surface when said frame is attached to said boot.

10. The skate of claim 9 wherein:

each said frame mount defines a ceiling;

each said floor is defined in part by a top floor surface and a bottom floor surface; and each rail includes an upper front edge and an upper rear edge, each of which confronts and lies substantially flush with said sole to define said curved rail bearing surface, each of said brackets of said first side rail being spaced downward from said outer sole surface to define a tensioning gap between said ceiling and said top floor surface when said front and rear edges initially contact said sole of said boot, each said gap closing as said sole is pulled towards said top floor surface as said frame is attached to said boot, said sole being placed under tension to provide a more rigid interface between said frame and said boot.

11. The skate of claim 10 wherein:

said first and second side rails each having a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said fingers cam in said mating apertures when said sole is being tensioned as said frame and said sole are attached to each other, said camming inhibiting lateral twisting and flexing of said side walls.

12. The skate of claim 10 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

13. The skate of claim 9 wherein:

said first and second side rails each have a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said fingers cam in said mating apertures when said sole is being tensioned as said frame and said sole are attached to each other, said camming inhibiting lateral twisting and flexing of said side rails.

14. The skate of claim 13 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

15. The skate of claim 9 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

16. The skate of claim 1 wherein said sole includes an inner sole surface, said inner sole surface including a front fastener receiver and a rear fastener receiver, each receiver for receiving said fastening means.

17. The skate of claim 16 wherein said front and said rear fastener receivers include a first disk-like depression of radius $r_1$ disposed at a first level in said inner sole surface and capable of receiving a first radius washer and a second disk-like depression of radius $r_2$ disposed at a second level in said inner surface and capable of receiving a second radius washer, wherein $R_1 > r_2$ and wherein said first level is higher than said second level.

18. The skate of claim 17 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

19. The skate of claim 1 wherein said side rails includes a plurality of identically configured pairs of axle aperture and a plurality of axle apertures plugs, each said aperture being configured to receive an axle aperture plug and to prevent rotation of said plug, and wherein each said plug has an eccentrically disposed axle bore such that said bore is capable of assuming a plurality of positions with respect to said axle aperture, whereby said wheels of said skate may be mounted at varying relative heights.

20. The skate of claim 19 wherein each said rail includes:

four axle apertures, said four axle apertures including a forward axle aperture, two center axle apertures, and a rear axle aperture, and said plurality of wheels is four wheels, each axle aperture having an elongated configuration defined by a longitudinal axis and disposed on said rail such that said axes are generally upright and are mutually parallel; and wherein said axle apertures are further disposed on said side rail such that the two center axle apertures are at a first common height and the forward and rear axle apertures are at a second common height, wherein said first height is lower than said second height.

21. The skate of claim 20 wherein said first and second heights are related such that the wheels associated with said first height are capable of being disposed relative to the wheels associated with the second height in at least three different heights.

22. The skate of claim 19 wherein said axle apertures are disposed on said side rails such that at least two wheels of said plurality may be disposed in at least three relative heights to each other.

23. The skate of claim 19 wherein:

each said frame mount defines a ceiling;

each said floor is defined in part by a top floor surface and a bottom floor surface; and each rail includes an upper front edge and an upper rear edge, each of which confronts and lies substantially flush with said sole, each of said brackets of said first side rail being spaced downward from said outer sole surface to define a tensioning gap between said ceiling and said top floor surface when said front and rear edges initially contact said sole of said boot, each said gap closing as said sole is pulled toward said top floor surface as said frame is attached to said boot and said sole is placed under tension to provide a more rigid interface between said frame and said boot.

24. The skate of claim 19 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

25. The skate of claim 19 wherein:

said first and second side rails each have a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said fingers cam in said mating apertures when said sole is being tensioned as said frame and said sole are attached to each other, said camming inhibiting lateral twisting and flexing of said side rails.

26. The skate of claim 1 wherein each said front and rear mounting bracket of said first side rail includes forward and rear bracket walls extending downwardly from said floor to define therebetween a front bracket channel and a rear bracket channel respectively, and wherein said front and rear mounting brackets of said second side rail are each configured to conform closely to said front and rear bracket channels respectively.

27. The skate of claim 26 wherein:

each said frame mount defines a ceiling;

each said floor is defined in part by a top floor surface and a bottom floor surface, said top surface of said floor lying substantially flush with and bearing against said ceiling when said frame is attached to said boot, and wherein each rail includes an upper front edge and an upper rear edge, each of which confronts and lies substantially flush with said sole, each of said brackets of said first side rail being spaced downward from said outer sole surface to define a tensioning gap between said ceiling and said top floor surface when said front and rear edges initially contact said sole of said boot, each said gap closing as said sole is pulled toward said top floor surface as said frame is attached to said boot and said sole is placed under tension to provide a more rigid interface between said frame and said boot.

28. The skate of claim 27 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

29. The skate of claim 27 wherein:

said first and second side rails each have a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said fingers cam in said mating apertures when said sole is being tensioned as said frame and said sole are attached to each other, said camming inhibiting lateral twisting and flexing of said side rails.

30. An in-line roller skate comprising:

a boot having a sole, said sole having an outer sole surface, said outer sole surface having front and rear frame mounts thereon, each said frame mount having a pedestal-like configuration having a base depending downward from said outer sole surface and defining a substantially planar ceiling, each said frame mount further including forward and aft stop barriers projecting downwardly from said ceiling to define a laterally extending slot therebetween;

a plurality of wheels rotatable in a common plane;

a frame for carrying said plurality of wheels, said frame comprising first and second longitudinally extending side rails, wherein said first side rails includes front and rear mounting brackets, each said bracket projecting laterally toward said second side rail from said first side rail and having a bracket floor, each said bracket further including forward and aft bracket walls extending downwardly from said floor to define therebetween a bracket slot, each said bracket being received in one of said slots of said frame mounts when said frame is attached to said boot, said second side rail includes front and rear mounting brackets, each said bracket projecting laterally from said second rail toward said first rail and configured to conform closely to said bracket slots of said first rail brackets when said frame is attached to said boot; and fastening means for attaching rails to said boot by attaching said front brackets of said first rail to said front bracket of said second rail and said front frame mount, said front bracket of said first rail being disposed between said front bracket of said second side rail and said front frame mount, and by attaching said rear bracket of said first side rail to said rear bracket of said second side rail and to said rear frame mount, said rear bracket of said first rail being disposed between said rear bracket of said second side rail and said rear frame mount.

31. The skate of claim 30 wherein:

each said bracket floor is defined in part by a top floor surface and a bottom floor surface, and wherein each rail includes an upper front edge and an upper rear edge, each of which confronts and lies substantially flush with said sole, each of said brackets of said first side rail being spaced downward from said outer sole surface to define a tensioning gap between said ceiling and said top floor surface when said front and rear edges initially contact said sole of said boot, each said gap closing as said sole is pulled toward said top floor surface as said frame is attached to said boot and thereby placing said sole under tension.

32. The skate of claim 30 wherein said fastening means includes:

a bolt having a shaft, said shaft having a head capable of receiving a fastening tool disposed at one end thereof and a threaded end at the other end thereof;

a threaded fastener for receiving and retaining said bolt; and wherein each said frame mount of said boot has a fastening aperture extending therethrough for receiving said bolt shaft;

each said mounting bracket of said first side rail has a fastening aperture extending therethrough for receiving said bolt shaft; and each said mounting bracket of said second side rail includes a box channel, said box channel defining a socket receiving and retaining said threaded fastener to prevent rotation thereof and each said socket of said second side rail having a fastening aperture extending therethrough for receiving said threaded end of said bolt shaft;

whereby said frame is attached to said boot by inserting a bolt through each said frame mount from the inside of said boot, through each said bracket of said first and second side rails and into said socket for attaching said threaded end to said retained threaded fastener.

33. The skate of claim 30 wherein:

said first and second side rails each have a plurality of fingers projecting upwardly from said upper edges thereof;

said boot outer sole surface has a plurality of mating apertures, each said mating aperture being configured to mateably receive one of said fingers when said frame is attached to said boot; and wherein a plurality of said fingers cam in said mating apertures when said sole is being tensioned as said frame and said sole are attached to each other, said camming inhibiting lateral twisting and flexing of said side rails.

* * * * *